US005544503A

United States Patent [19]

Miyamoto

[11] Patent Number: 5,544,503

[45] Date of Patent: Aug. 13, 1996

[54] TENSION SWITCH ASSEMBLY AND YARN CONDUCTOR OF KNITTING MACHINE

[75] Inventor: Masaki Miyamoto, Wakayama, Japan

[73] Assignee: Shima Seiki Manufacturing Ltd., Wakayama, Japan

[21] Appl. No.: 369,693

[22] Filed: Jan. 6, 1995

[30] Foreign Application Priority Data

Jan. 10, 1994 [JP] Japan ..... 6-000673

[51] Int. Cl.[6] ..... D04B 15/44

[52] U.S. Cl. ..... 66/146; 66/60 R; 66/162

[58] Field of Search ..... 66/60 R, 145 R, 66/145 B, 146, 157, 158, 160, 162, 161, 163; 242/410, 413, 413.6; 226/11, 48, 45

[56] References Cited

U.S. PATENT DOCUMENTS 4,535,609 8/1985 Goller et al. ..... 66/146
4,551,591 11/1985 Jones ..... 28/187
4,790,151 12/1988 Goller et al. ..... 28/157

FOREIGN PATENT DOCUMENTS 1042889 11/1953 France .
2919916 11/1980 Germany .
3633108 3/1988 Germany .

*Primary Examiner*—C. D. Crowder
*Assistant Examiner*—Larry D. Worrell, Jr.
*Attorney, Agent, or Firm*—Nikaido, Marmelstein, Murray & Oram LLP

[57] ABSTRACT

A break in twice as many yarns is made detectable merely by slightly modifying the tension switch assembly of a knitting machine. A yarn conductor 20 is rotatably attached to the forward end of an arm 16 of the assembly and provided with a pair of yarn supports 26, 27 on opposite sides of a rotational pin 19. Upon a break occurring in the yarn 2 retained on one of the yarns supports 26, 27, torques exerted by the yarns 2, 2 on the respective supports 26, 27 are brought out of balance to rotate the yarn conductor 20 and release the remaining other yarn 2 from the support 27.

10 Claims, 8 Drawing Sheets

TENSION SWITCH ASSEMBLY AND YARN CONDUCTOR OF KNITTING MACHINE

FIELD OF THE INVENTION

The present invention relates to tension switch assemblies and yarn conductors for use in knitting machines, and more particularly to a tension switch assembly which is adapted to detect a break in at least two yarns although it is a single device and to a member therefor. Examples of knitting machines are flat knitting machines, warp knitting machines and circular knitting machines.

PRIOR ART

Knitting machines include tension switch assemblies for detecting exhaustion of the knitting yarn or a break in the yarn and imparting tension to the yarn. The assembly detects exhaustion of the yarn on a cone or a break occurring in the yarn for one cause or another and stops the knitting machine before the yarn end is knitted into a fabric to prevent creation of a flaw in the fabric.

Such tension switch assemblies are already in actual use and known as disclosed in German Patents 2919916A1, 3310132C, 3633108A1, etc. For example, the tension switch assembly of the flat knitting machine is disposed in the path of feed of a yarn on a support member which. is provided transversely above a cone stand plate, and has a main body mounted on the support member. An arm comprising a resilient member has one end pivoted to the main body and a forward end always so biased as to tension the yarn. The forward end of the arm is provided with a yarn support for inserting the yarn therethrough. The yarn to be used is paid off from a cone mounted on the cone stand plate, passed through a yarn guide, yarn brake and knot detector and thereafter through a yarn guide, yarn support and yarn guide, guided by a side tension and yarn feeder and fed to a needle.

When the yarn tensioned by the tension switch assembly has been exhausted, the arm with the yarn inserted through the yarn support at its forward end pivotally moves upward from a lowered position. A sensor detects the pivotal movement of the arm, where-upon the sensor feeds a stop signal to the control unit of the knitting machine to discontinue the operation of the machine. The operator thereafter ties the yarn unwound from a new cone to the end of the preceding yarn and resumes the operation of the machine, whereby the fabric being knitted can be further knitted free of a flaw.

The support member extending transversely above the cone stand plate is provided with a plurality of tension switch assemblies, whereas in the case of intersia or jacquard knitting using many yarns or in the case where yarns are laid in parallel to knit many yarns into a fabric, the number of tension switch assemblies is insufficient for the multiplicity of yarns used. An increase in the number of assemblies nevertheless requires a major modification of the knitting machine construction, giving rise to problems as to the cost and the space available for installation.

Two yarns as arranged in parallel can be inserted through the yarn support of one tension switch assembly, but when only one of the yarns has been exhasuted, the assembly is unable to detect the exhaustion although capable of detecting simultaneous exhaustion of both yarns. Accordingly, there arises a need for the operator to monitor the quantity of yarn remaining on the cone. Thus, the operator, monitoring the quantity of yarn on the cone, stops the knitting machine when the quantity of remaining yarn has diminished, before the cone is exhausted of the yarn, ties the yarn on another cone to the preceding yarn and resumes the operation of the machine. However, this method necessitates the operator for monitoring the quantity of yarn remaining on the cone, permitting a flaw to occur in the fabric being knitted if the operator fails to recognize exhaustion of the yarn.

SUMMARY OF THE INVENTION

An object of the present invention is to make it possible to detect a break in two yarns by a single tension switch assembly.

The term a "break in the yarn" or "yarn break" is used herein as including exhaustion of the yarn.

The present invention provides a tension switch assembly for use in knitting machines which comprises an arm, a main body and a sensor for detecting a pivotal movement of the arm, the arm having a forward end for guiding a yarn in the vicinity thereof and a base end pivotably attached to the main body so as to tension the yarn, the sensor being operable to detect the pivotal movement of the arm due to a break in the guided yarn to stop the operation of the knitting machine, the tension switch assembly being characterized in that a yarn conductor having a rotation supporting point and a pair of yarn supports arranged respectively on opposite sides of the supporting point is directly or indirectly attached to a portion of the arm in the vicinity of its forward end rotatably about the supporting point.

The invention provides a yarn conductor to be attached to a forward end of a yarn break detecting arm of a tension switch assembly of a knitting machine for guiding a yarn, the yarn conductor being characterized in that the conductor has a rotation supporting point approximately at the center thereof and a pair of yarn supports arranged respectively on opposite sides of the supporting point.

The rotation supporting point is suitable insofar as the point keeps the yarn conductor rotatable relative to the arm. For example, a pin, ball or like rotational member is useful. In this case, a pinhole or a socket for the ball to provide a ball joint is formed in the intermediate member to be described later. A pinhole, ball joint socket or the like is also useful as the supporting point. In this case, a pin, ball or the like is provided on the arm or the intermediate member. A ring or the like is further useful as the supporting point. Of these, the combination of pin and pinhole is the simplest, and the yarn conductor may be provided with the pin serving as a rotational member or with the pinhole for receiving the rotational member.

The yarn conductor need not be rotatable through 360 degrees about the rotation supporting point insofar as it is rotatable through an angle permitting the yarn remaining thereon without a break to slip off the yarn support. The yarn support, which is a hook in the case of embodiments, may be, for example, a mere arm provided that the yarn is retainable on the support without slipping off owing to vibration due to variations in the tension acting on the yarn during knitting. The hook is desirable since it is simple in construction and less likely to allow the yarn to slip off owing to vibration. A yarn stopper may be provided as opposed to the hook in the case where the knitting operation involves marked vibration which is likely to cause the yarn to slip off if the hook only is used.

The plane of rotation of the yarn conductor is preferably a plane containing the line of the arm forward end. For example, when the line of the arm forward end is approximately vertical, it is desired that the plane of rotation be substantially vertical.

The tension switch assembly, although attached to the top tension according to the embodiments, may be positioned otherwise; the assembly may be attached, for example, to the-side tension. Besides the flat knitting machine, the type of knitting machine is any of the warp knitting machine, circular knitting machine, glove knitting machine, etc. The yarns held by the pair of yarn supports respectively may be positioned side by side for knitting or arranged otherwise for knitting as passed through individual yarn feeders.

Preferably, the rotation support point is provided, on one side thereof opposite to the arm, with a yarn support portion at a position intermediate between the pair of yarn supports. With some of the embodiments, the yarn support portion is in the form of a hole although not limitative. A loop, hook, whorl or the like may serve as the yarn support portion, and this portion need not always be a perfect hole. It is then possible to monitor one yarn by one tension switch assembly as in the prior art when the number of assemblies involves an allowance, or to monitor two yarns by one assembly if otherwise.

The forward end of the arm is conventionally in the form of a U-shaped loop for inserting a yarn therethrough. Accordingly, if the yarn conductor is attached to the arm end by means of an intermediate member formed with a U-shaped groove, a conventional tension switch assembly is made usable as it is for handling twice as many yarns merely by adding the intermediate member and the yarn conductor. Next, the tension switch assembly is usually provided with a yarn brake and knot detector in addition to the arm and sensor. These means are usable in common also for handling two yarns. For example, two yarns can be braked by one yarn brake, and knots on two yarns are detectable by one knot detector. Thus, even if one arm is adapted to detect a break in two yarns, the main body of the tension switch assembly need not be modified and will not increase in size.

The operation of the tension switch assembly or the yarn conductor of the invention will be described. A yarn is retained by each of the pair of yarn supports, is tensioned with a force delivered from the arm and exerts a torque on the rotation supporting point through the support. The torques from the pair of yarns are opposite in direction, usually offset each other and will not rotate the yarn conductor. Upon a break occurring in one of the yarns in this state, the balance between the torques acting on the supporting point is upset, permitting the yarn conductor to rotate relative to the arm. For example when the tension switch assembly is attached to the top tension, the yarns are pulled downward, with an upward tension acting on the arm. If a break then occurs in one of the yarns, the torque from the other yarn, i.e., the remaining yarn, rotates the conductor, whereby the yarn support holding the remaining yarn is revolved downward. Consequently, the remaining yarn slips off the support, allowing the yarn conductor to be further raised by the tension on the arm. The sensor detects this pivotal movement to stop the knitting machine. Thus, with the yarn conductor of the present invention, the break in one of the yarns causes the other yarn to slip off to amplify the variation in the force on the arm due to the break for the sensor to detect the resulting force.

EMBODIMENTS

Figure 1:
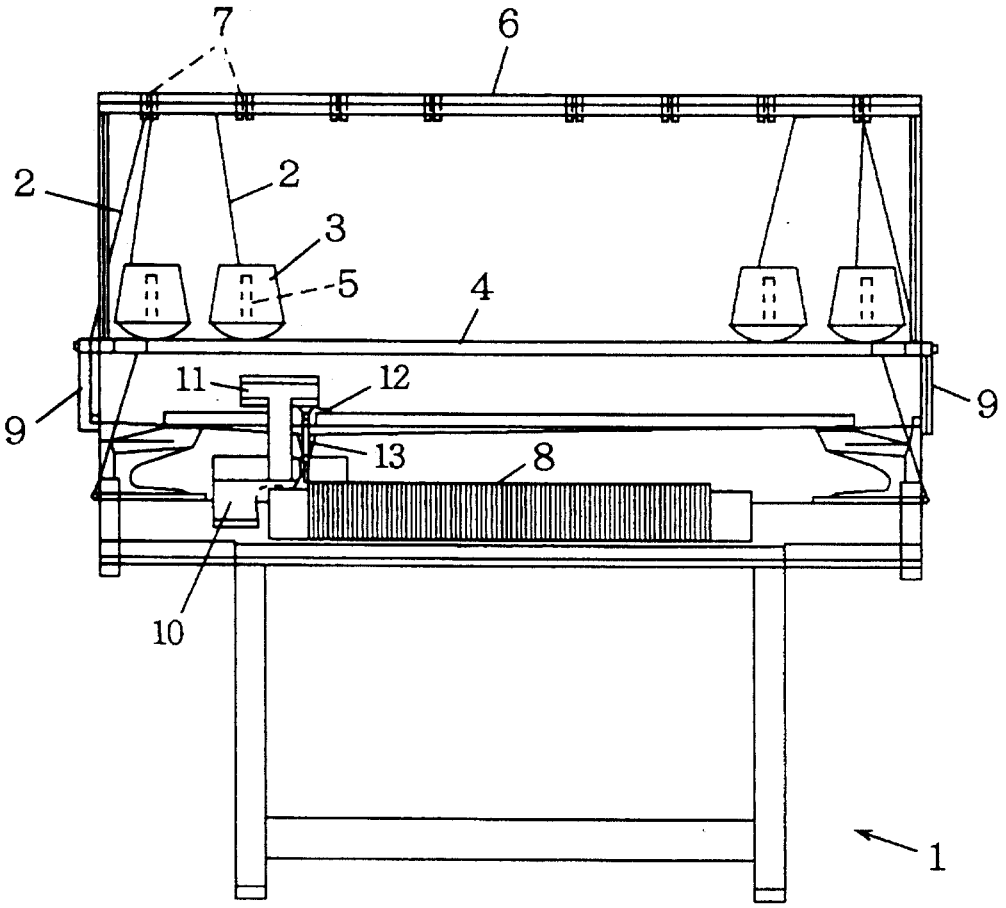
FIG. 1 is a front view of a flat knitting machine equipped with tension switch assemblies embodying the invention.

Tension switch assemblies and yarn conductors embodying the invention will be described with reference to the drawings. FIG. 1 shows a flat knitting machine 1 equipped with tension switch assemblies. Cones 3 each having wound thereon a yarn 2 for knitting are placed respectively on cone stands 5 mounted on a cone stand plate 4. The yarn 2 paid off from the cone 3 on each cone stand 5 is guided by unillustrated yarn guides arranged at different locations on the path of feed of the yarn to the tension switch assembly 7 mounted on a support member 6 which is provided above the stand plate 4 transversely of the machine. The yarn 2 passing through the assembly 7 is given a suitable tension by a side tension 9 disposed at each side of a needle bed 8, fed by a yarn feeder 13 to the hook of an unillustrated needle and knitted into a fabric. A carriage 10 is slidable on the needle bed 8 in opposite directions transversely of the machine 1 and has a coupling, on which a carrier control 11 is provided for moving a yarn carrier 12 therewith. The yarn feeder 13 is attached to the carrier 12, and the needle is slidable forward and backward by an unillustrated cam which is mounted on the carriage 10.

With the flat knitting machine 1, two yarns 2, 2 unwound from different cones 3, 3 are guided by unillustrated yarn guides individually and thereafter inserted as arranged side by side through a single yarn guide 14 of the tension switch assembly 7.

Figure 2:
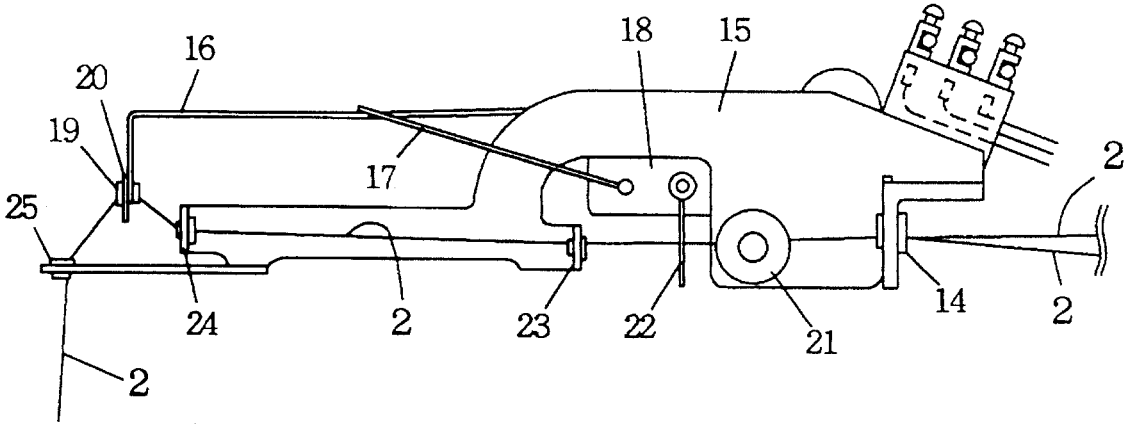
FIG. 2 is a side elevation of the tension switch assembly.
Figure 3:
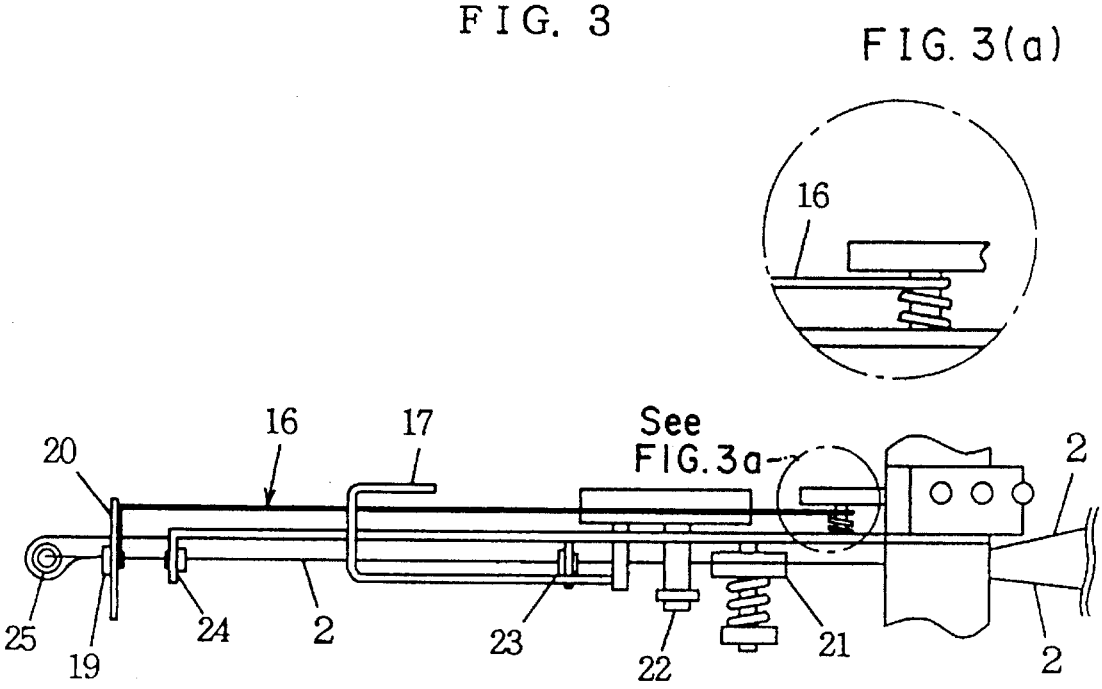
FIG. 3 is a plan view of the tension switch assembly.

As shown in FIGS. 2 and 3, the assembly 7 has a main body 15 which is attached to the support member 6 provided above the cone stand plate 4 of the machine 1. An arm 16 is made of a resilient member and has one end bent into a spring and pivoted to the main body 15 and a forward end which is biased by the resiliency of the arm so as to impart a tension to the yarns in travel. A yarn conductor 20 is rotatably attached to a portion of the arm 16 in the vicinity of its forward end, i.e., to the forward end in the present embodiment, by a rotational pin 19 serving as a supporting point for rotation relative to the arm 16. At least a specified amount of pivotal movement of the arm 16 is detected by a detection arm 17, and the pivotal movement of the arm 17 is detected by a sensor 18, which in turn feeds a stop signal to an unillustrated control unit of the knitting machine. The yarns 2, 2 paid off from the different cones 3, 3, passed through the respective guides and inserted through the common yarn guide 14 of the assembly 7 are inserted as arranged side by side through a known yarn brake 21, knot detector 22, yarn guide 23, yarn guide 24 and yarn guide 25 in the order mentioned. The sensor 18 serves also as a sensor for the knot detector 22 and stops the machine 1 upon detecting a knot.

Figure 4:
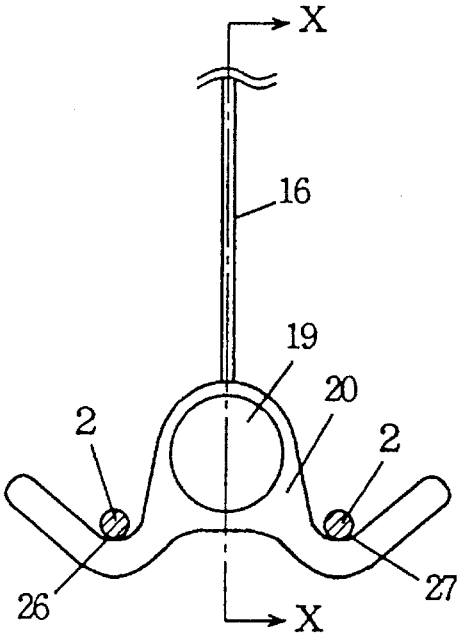
FIG. 4 is a front view showing a yarn conductor of the first embodiment.

FIG. 4 shows the yarn conductor 20 rotatably supported by the forward end of the arm 16. The yarn conductor 20 supported by the forward end of the arm 16 is provided with a pin, e.g., rotational pin 19, and a pair of opposite yarn supports 26, 27 on opposite sides of the pin 19 at the lower side thereof for retaining the respective yarns 2, 2 thereon.

Figure 5:
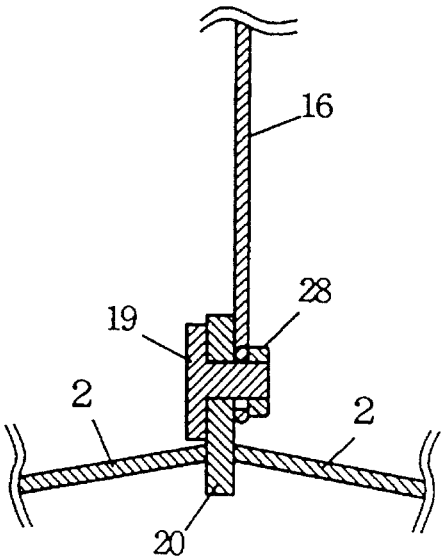
FIG. 5 is a view in section taken along the line X—X in FIG. 4.
Figure 6:
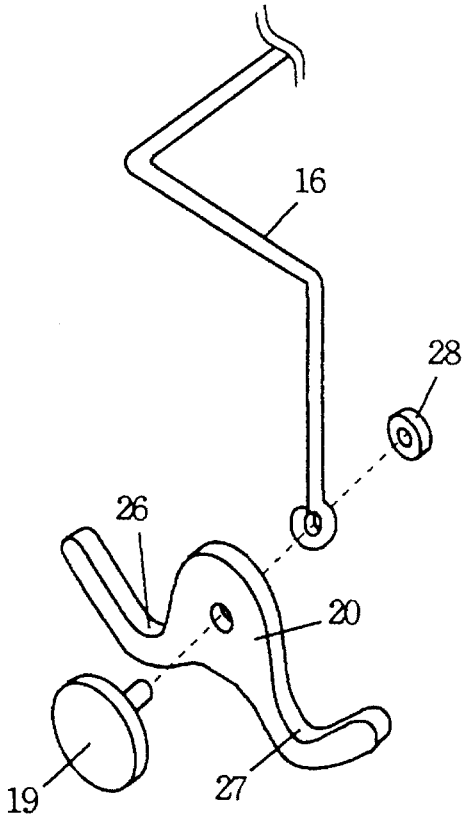
FIG. 6 is an exploded perspective view of the yarn conductor of the first embodiment.

FIG. 5 is a view in section taken along the line X—X in FIG. 4, and FIG. 6 is a perspective view showing how the yarn conductor 2 is attached to the arm 16. With reference to FIGS. 5 and 6, the conductor 20 is attached to the forward end of the arm 16 rotatably relative to the arm 16 by the rotational pin 19 serving as a supporting point for rotation relative to the arm 16 and by a stopper 28 such as a nut or crimped ring.

Figure 7:
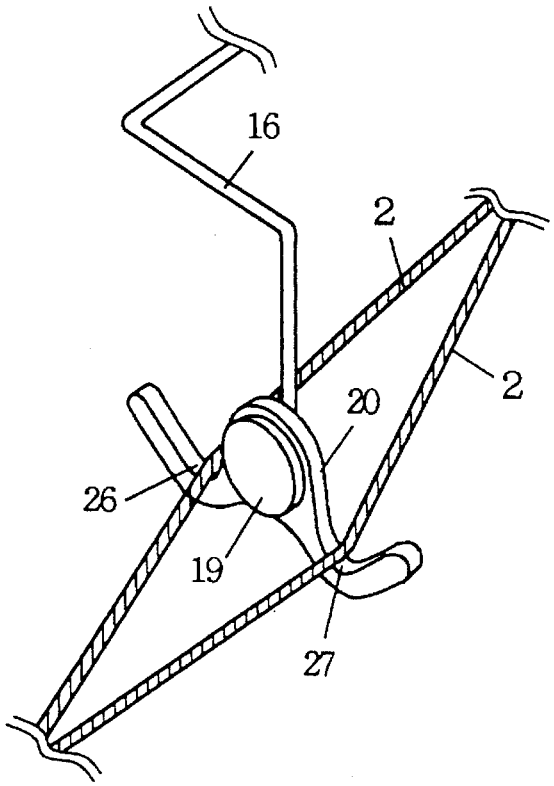
FIG. 7 is a perspective view showing yarns as retained on the conductor of the first embodiment.

FIG. 7 shows the yarns 2, 2 retained on the pair of yarn supports 26, 27, respectively. The supports 26, 27 each comprise, for example, a hook. The opposite supports 26, 27 retain the two yarns 2, 2, respectively. Accordingly, the yarns 2, 2 are tensioned by a force from the arm 16, which is in turn held shifted downward by the yarns 2, 2. The yarns 2, 2 are positioned side by side by the yarn guides 24 and 25 to the front and rear of the conductor 20.

Figure 8:
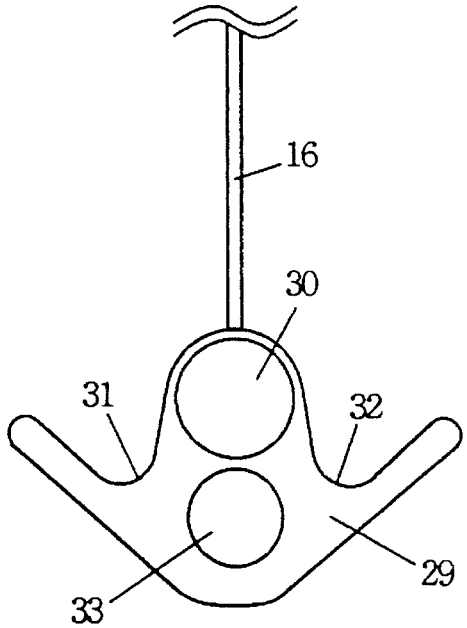
FIG. 8 is a front view of a yarn conductor of a second embodiment.

FIG. 8 shows a second embodiment. As in the first embodiment, a yarn conductor 29 is formed with a pair of opposite yarn supports 31, 32 on opposite sides of a rotational pin 30, respectively. In preparation for the case wherein a single yarn is monitored by one tension switch assembly 7, a yarn support portion 33 in the form of a hole is formed under the rotational pin 30. The support portion 33 is not limited to a hole insofar as the yarn can be inserted therethrough.

Figure 9:
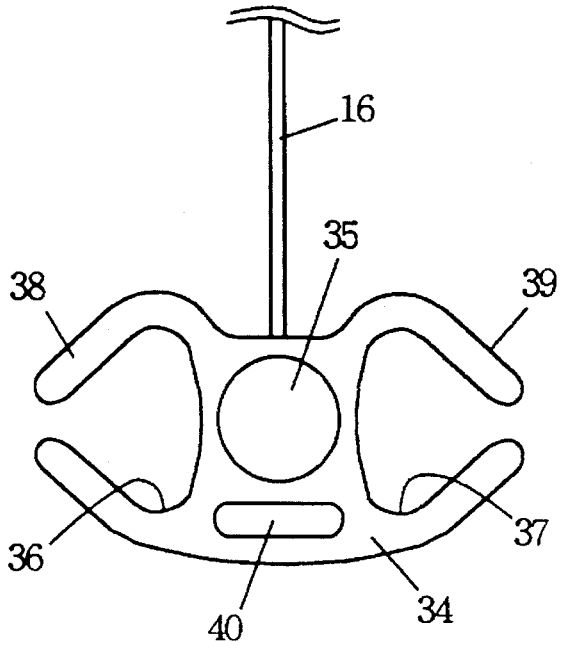
FIG. 9 is a front view of a yarn conductor of a third embodiment.

FIG. 9 shows a third embodiment. With this embodiment, a yarn conductor 34 is formed with a pair of opposite yarn supports 36, 37 on opposite sides of a rotational pin 35, respectively, and has yarn stoppers 38, 39 opposed to the respective supports 36, 37 for preventing the yarn from jumping out. A yarn support portion 40 is formed also in this embodiment for use in detecting a break in only one yarn.

According to the foregoing embodiments, the base end of the arm 16 is bent into a spring and attached to the main body 15, and the forward end of the arm 16 is biased upward by the resiliency of the arm 16 itself, whereas a separate spring may be attached to the arm 16 for upwardly biasing the forward end of the arm 16 by the spring.

Although the foregoing embodiments have the detection arm 17 and mechanical sensor 18 for detecting the pivotal movement of the arm 16, also usable is a sensor other than the mechanical sensor, such as an optical sensor or electrical sensor.

Figure 10:
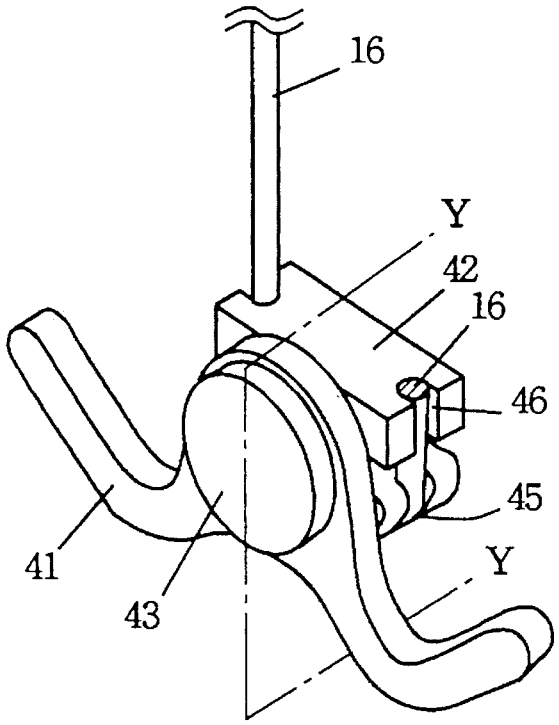
FIG. 10 is a perspective view showing a yarn conductor and an intermediate member of a modified embodiment.
Figure 11:
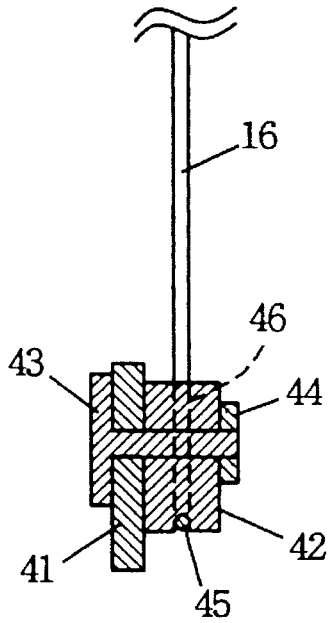
FIG. 11 is a view in section taken along the line Y—Y in FIG. 10.
Figure 12:
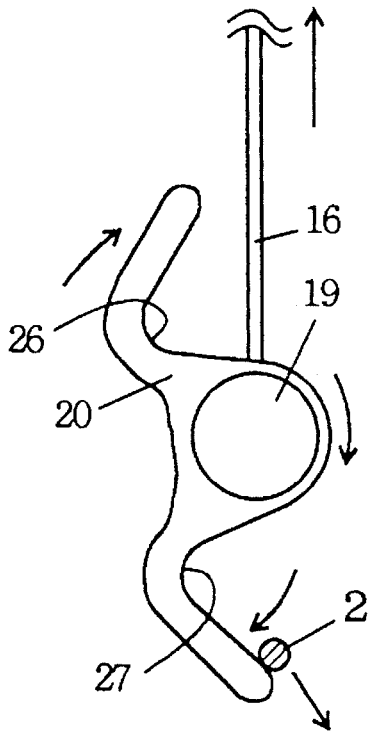
FIG. 12 is a front view showing the movement of the yarn conductor upon a break of the yarn.

Further with the above embodiments, the yarn conductor 20 is supported directly by the forward end of the arm 16. As shown in FIGS. 10 and 11, however, a yarn conductor 41 and an intermediate member 42 may be rotatably supported by a pin, i.e., rotational pin 43, and a stopper 44. An arm 16 has at its forward end a U-shaped engaging portion 45 which is engaged in a U-shaped groove 46 formed in the intermediate member 42. Conventional tension switch assemblies have an arm 16 which is bent at its forward end into a U-shaped loop for inserting a yarn 2 therethrough, so that when the bent portion is engaged as the engaging portion 45 in the intermediate member 42, the conventional assembly can be used as it is. In this case, the conductor 41 is rotatable relative to the intermediate member 42, and the arm 16 is engaged in the U-shaped groove 46 of the intermediate member 42. Thus, the method of attaching the yarn conductor to the arm is not limited to that shown in the embodiment.

The operation of the embodiments will be described. With reference to FIGS. 2 and 7, the pair of opposite yarn supports 26, 27 are caused to retain yarns 2, 2 thereon, whereby the arm 16 is held downwardly shifted, with the force of the yarns 2, 2 acting against an upwardly biasing force. Between the yarn guides 24, 25 arranged to the front and rear of the yarn conductor 20 at the arm forward end, the yarns 2, 2 are slightly raised upward by being pulled by the arm 16 and a suitable tension is given. In this state, the forces exerted by the yarns 2, 2 respectively on the pair of yarn supports 26, 27 are in balance, and the torques delivered from the yarns 2, 2 to the rotational pin 19 offset each other. Consequently, the yarn conductor 20 remains unrotated in balance.

Next, a description will be given of the case wherein the cone 3 on the cone stand 5 has been exhaused of the yarn 2 or a yarn break has occurred for one cause or another. It is now assumed that of the two yarns 2, 2 on the pair of yarn supports 26, 27 formed on the yarn conductor 20, a break has occurred in the yarn 2 on the left support 26. With the yarn broken, the yarn 2 remains on the right yarn support 27 only, reducing the force exerted by the yarns 2, 2 on the arm 16 to one half, so that the arm 16 rises slightly. The torque from the right support 27 only is delivered to the rotational pin 19, whereby the conductor 20 is rotated clockwise to lower the support 27 and release the yarn 2 from the support 27. Consequently, the arm 16 further rises, the rise is converted to a pivotal movement of the detection arm 17, and the sensor 18 detects this movement and feeds a signal to the control unit of the knitting machine 1 to stop the machine.

Figure 13:
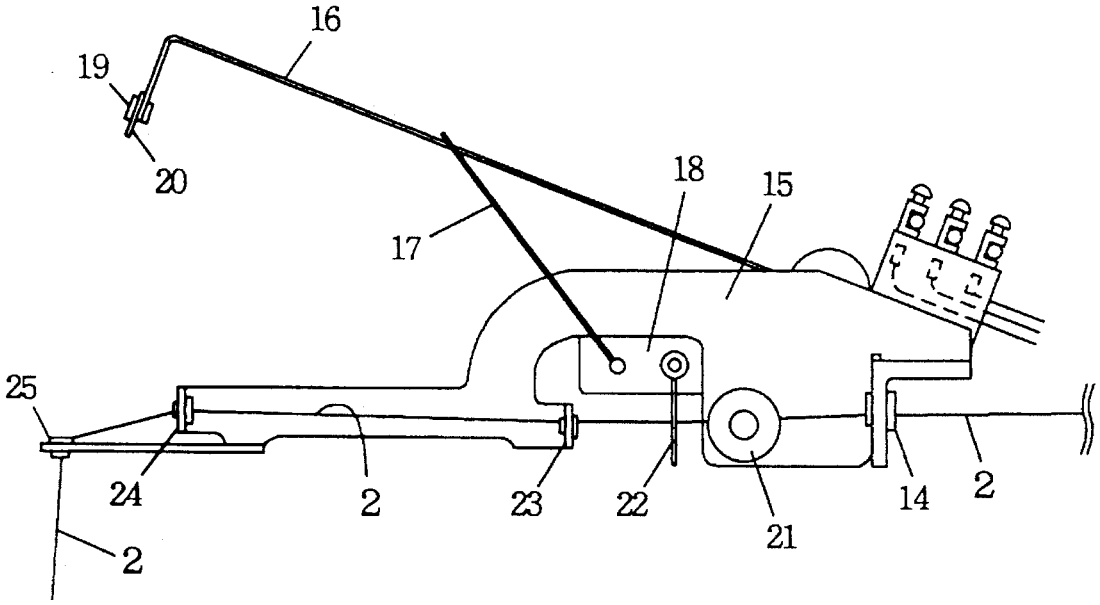
FIG. 13 is a side elevation showing the tension switch assembly upon the yarn breaking.

FIG. 13 shows the assembly with the yarn 2 released from the conductor 20. The yarn 2 extends straight between the yarn guides 24, 25, and the arm 16 is in an upwardly moved position.

When the yarn conductor 29 of the second embodiment is to be used for detecting a break in two yarns 2, 2, these yarns 2, 2 are retained on the pair of yarn supports 31, 32, respectively. When the conductor is to be used for detecting a break in a single yarn 2, the yarn 2 is inserted through the yarn support portion 33.

With the third embodiment shown in FIG. 3, the yarn conductor 34 has the yarn stoppers 38, 39 for preventing yarns 2 from jumping out. With this embodiment, even when the arm 16 jolts up and down to raise the yarn 2 off the support 36 or 37 owing to an abrupt variation in the tension given to the yarn 2 by the yarn feeder, the stopper 38 or 39 precludes the yarn 2 from slipping off the yarn conductor 34.

In the case of the first and second embodiments, marked variations in the tension acting on the yarns 2, 2 are detectable utilizing the fact that the yarns 2, 2 readily slip off from the supports (26, 27), (31, 32). More specifically, if a great difference occurs between the tensions on the pair of yarns 2, 2 retained on the yarn supports (26, 27) or (31, 32), one of the yarns 2, 2 rises off the support and is released therefrom to rotate the yarn conductor 20 or 29. This serves not only to detect a yarn break but also to prevent faults from occurring in the knitted fabric which are likely to result from a knitting operation involving a great difference between the tensions on the respective yarns 2, 2.

Figure 14:
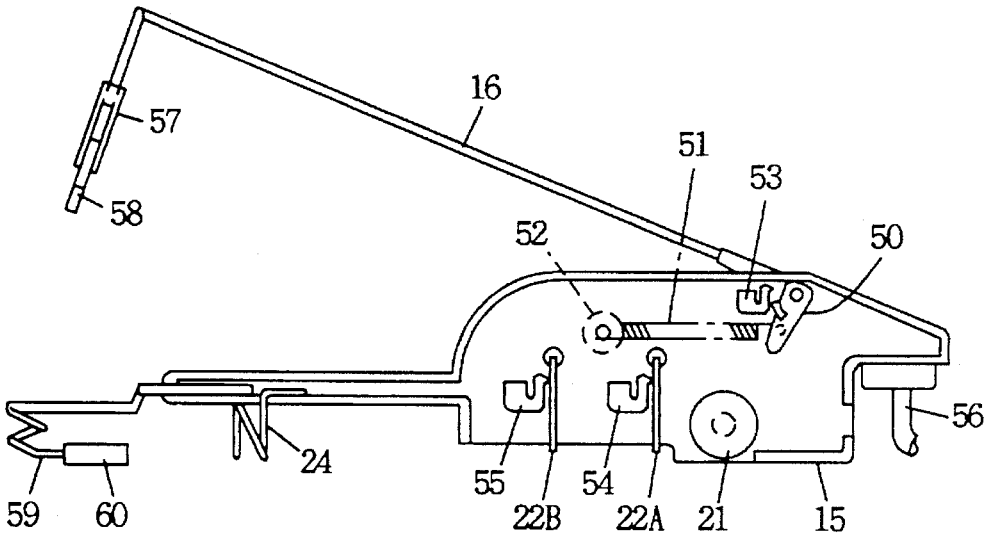
FIG. 14 is a side elevation partly broken away and showing a fourth embodiment.
Figure 15:
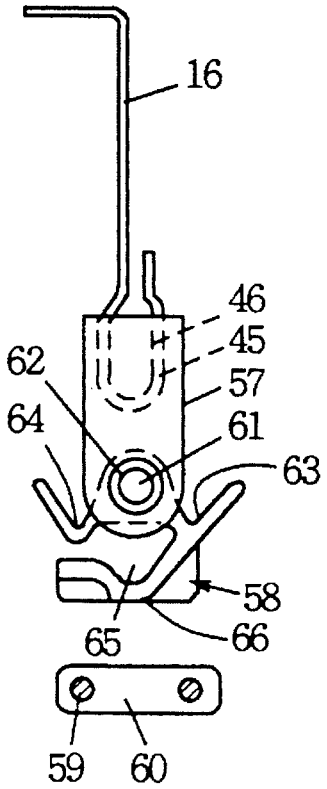
FIG. 15 is a fragmentary front view showing an arm, intermediate member, yarn conductor and yarn guide of the fourth embodiment.
Figure 16:
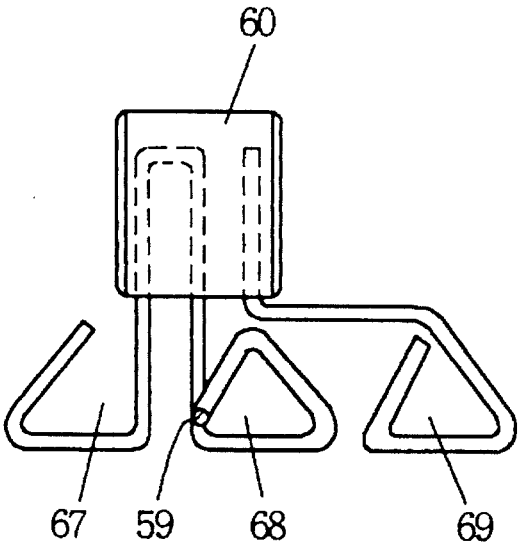
FIG. 16 is a fragmentary plan view of the yarn guide of the fourth embodiment.

FIGS. 14 to 16 show a fourth embodiment. As seen in FIG. 14, this embodiment has a rotatable lever 50 attached to the base end of a lever 16, and a spring coil 51 for biasing the lever 50 to bias the arm 16 upward. The biasing degree is adjustable by rotating an adjusting switch 52 attached to the other end of the coil 51. Indicated at 53 is a limit switch. When the arm 16 rotates upward, a notched portion of the lever 50 pushes an actuator of the limit switch 53, whereby a yarn break is detected. Indicated at 22A, 22B are a pair of knot detectors which per se are known. When the width of the yarn 2 becomes larger than the clearance between the main body 15 and the knot detector 22A or 22B, the knot detector 22A or 22B is pushed leftward in the drawing to actuate a limit switch 54 or 55 to detect a knot. The clearance between the main body 15 and the knot detector 22A or 22B is adjustable by an unillustrated pin. The detector 22A detects a thick knot and stops the knitting machine 1. The detector 22B detects a thin knot, whereupon the detector temporarily reduces the knitting speed of the machine 1. Indicated at 56 is a signal transmission code, at 57 an intermediate member attached to the forward end of the arm 16, at 58 a yarn conductor, at 59 a yarn guide for feeding the yarn 2 to a side tension 9, and at 60 a flat member attached to the yarn guide 59.

The intermediate member 57 is so constructed that a U-shaped tongue is sandwiched between two plates. The two plates are separate except where the tonque is positioned to provide a clearance, in which an upper portion of the yarn conductor 58 is accommodated as shown in FIG. 15. The intermediate member 57 is prepared, for example, from a plastics by molding the tongue and the two plates into an integral piece. The arm 16 has at its forward end a U-shaped engaging portion 45, which is engaged in a U-shaped groove 46 around the U-shaped tongue. The yarn conductor 58 is rotatably held to the intermediate member 57. A pin 61 formed on one of the plates of the intermediate member 57 extends through a pinhole 62 formed in a middle upper portion of the yarn conductor 58 and serving as a rotation supporting point. The conductor 58 is held between the two plates and rotatable about the pin 61. Indicated at 63, 64 are a pair of yarn supports arranged on opposite sides of the pinhole 62 at the lower side of the pinhole 62. Indicated at 65 is a yarn support portion, and at 66 a flat face formed at the lower end of the conductor 58. The yarn conductor 58 of the present embodiment is also usable for retaining a pair of yarns 2, 2 on the respective yarn supports 63, 64, or for supporting a yarn on the support portion 65 only.

As shown in FIG. 16, the flat member 60, for example, of plastics is attached to the yarn guide 59, which is provided with three yarn support portions 67, 68, 69. The flat member 60 and the flat face 66 are provided for the reason to be described below. When a yarn 2 is set on each of the yarn supports 63, 64 or on the support portion 65, the conductor 58 is liable to descend into contact with the yarn guide 59. If the conductor 58 comes into contact with the guide 59 in the absence of the flat member 60 and the flat face 66, the conductor 58 is liable to rotate to release the yarn 2. The flat member 60 and the flat face 66 are therefore provided to prevent the yarn conductor 58 from rotation upon coming into contact with the yarn guide 59 and facilitate setting of the yarn 2.

The three yarn support portions 67, 68, 69 are provided to thereby separate the yarns 2, 2 sent forward as closely arranged side by side to the yarn guide 24 and render the yarns easy to set on the respective supports 63, 64 because the yarns 2, 2, if so arranged at both the yarn guides 59, 24, are difficult to set as separated on the supports 63, 64. Although the embodiment has the three yarn support portions 67, 68, 69, two of them may be provided in actuality. The yarn support portions 67, 68, 69 may alternatively be provided for the yarn guide 24 instead of the yarn guide 59 for the guide 24 to separate the closely arranged yarns 2, 2.

To describe the operation of the present embodiment, the embodiment is the same as the embodiment of FIGS. 10 and 11 with the exception of the different mechanism for detecting the pivotal movement of the arm 16, use of the new intermediate member 57 and yarn conductor 58, the combination of flat face 66 and flat member 60 for preventing inadvertent rotation of the yarn conductor 58, and use of the three yarn support portions 67, 68, 69 to render yarngs easily settable on the yarn supports 63, 64.

A pair of arms 16 may be provided respectively on opposite sides of the main body 15. In this case a break in up to four yarns 2 can be detected by one tension switch assembly. Even when the pair of arms 16 are used, the yarn brake 1, knot detectors 22A, 22B and yarn guide 24 may each be provided singly, and these means are serviceable for up to four yarns 2.

While the foregoing embodiments are the preferred embodiments of the present invention, the components thereof can be modified suitably without departing from the basic features of the invention.

What we claim is:

1. A tension switch assembly for use in a knitting machine said tension switch assembly Comprising:

an arm;

a main body and a sensor for detecting a pivotal movement of said arm;

said arm including a forward end for guiding a yarn, and a base end pivotably attached to the main body to tension the yarn, the sensor being operable to detect the pivotal movement of said arm due to a break in the yarn to stop an operation of the knitting machine, the tension switch assembly further comprising a yarn conductor having a rotation supporting point thereof and a pair of yarn supports arranged respectively on opposite sides of the rotation supporting point, said yarn conductor being coupled to a forward end portion of said arm, said pair of yarn supports being rotatably disposed about said rotation support point.

2. A tension switch assembly for use in a knitting machine as recited in claim 1, wherein said pair of yarn supports comprise a pair of hooks which are each configured to engage a respective pair of yarns, each yarn of said each yarn of said respective pair of yarns exerting a force on the rotation supporting point, and wherein a break in one of said respective pair of yarns causes a rotation of said yarn conductor and causes said yarn conductor to release another of said respective pair of yarns.

3. A tension switch assembly for use in a knitting machine as recited in claim 2, wherein the rotation supporting point comprises a pin.

4. A tension switch assembly for use in a knitting machine as recited in claim 2, further comprising an intermediate member engaged with the forward end portion of said arm wherein the yarn conductor is attached to the intermediate member and rotatably disposed about the rotation supporting point.

5. A tension switch assembly for use in a knitting machine as recited in claim 4, wherein said arm has a U-shaped engaging portion at the forward end portion thereof, and wherein the intermediate member has a U-shaped groove therein and the U-shaped engaging portion is engaged in the U-shaped groove.

6. A tension switch assembly for use in a knitting machine as recited in claim 2, wherein said main body includes a yarn brake and at least one yarn knot detector thereupon, and the respective pair of yarns retained on the pair of yarn supports are each configured to engage said yarn brake and the said knot detector.

7. A tension switch assembly for use in a knitting machine as recited in claim 2, wherein said yarn conductor includes an additional yarn support portion on one side of the rotation supporting point opposite to said arm and disposed between the pair of yarn supports.

8. A tension switch assembly for use in knitting machines as recited in claim 2, wherein said yarn conductor includes a pair of yarn stoppers opposed to the pair of yarn supports for preventing said each yarn from the respective pair of yarns from disengaging said yarn supports.

9. A tension switch assembly for use in a knitting machine as recited in claim 2, wherein said main body includes a yarn guide at an end thereof, and wherein the yarn conductor has a flat face at an end thereof opposite to said arm, and wherein a flat member is positioned opposite to the flat face of the yarn guide.

10. A tension switch assembly for use in a knitting machine as recited in claim 2, wherein the rotation supporting point comprises a pinhole.

* * * * *